US007893618B2

(12) United States Patent
Chen et al.

(10) Patent No.: US 7,893,618 B2
(45) Date of Patent: Feb. 22, 2011

(54) GAS DISCHARGE LAMP

(75) Inventors: Long Chen, Hsin County (TW); Hui-Hsiang Feng, Hsin Chu County (TW); Ya-Chuan Yeh, Hsin Chu County (TW)

(73) Assignee: Arclite Optronics Corporation, Hsin Chu County (TW)

( * ) Notice: Subject to any disclaimer, the term of this patent is extended or adjusted under 35 U.S.C. 154(b) by 139 days.

(21) Appl. No.: 12/425,397

(22) Filed: Apr. 17, 2009

(65) Prior Publication Data

US 2010/0264819 A1 Oct. 21, 2010

(51) Int. Cl.
*H01J 65/00* (2006.01)

(52) U.S. Cl. ..... 313/607; 313/594; 313/237; 313/571

(58) Field of Classification Search ..... None
See application file for complete search history.

(56) References Cited

U.S. PATENT DOCUMENTS 5,532,543 A * 7/1996 Van Der Leeuw et al. ..... 313/25
6,597,118 B2 * 7/2003 Arimoto et al. ..... 315/115
7,402,954 B2 * 7/2008 Van Den Nieuwenhuizen et al. ..... 313/625

* cited by examiner

*Primary Examiner*—Ashok Patel
(74) *Attorney, Agent, or Firm*—Leong C. Lei

(57) ABSTRACT

The gas discharge lamp contains a lamp body and an UV unit. The UV unit contains a separate airtight chamber wrapping around at least a neck member of the lamp body and covering at least a part of a Mo tinsel inside the neck member. The airtight chamber is filled with one or more gases capable of being ionized, and is wound by a conductor whose one end is connected to a conduction wire extended out of one of the neck members. When the gas discharge lamp is turned on, the gases in the airtight chamber are ionized to produce an UV light to penetrate the discharge chamber. The gas discharge lamp therefore could have a lower starting voltage and an improved starting efficiency. Additionally, as the airtight chamber provides a heat insulation effect, the temperature-induced stress is thereby reduced.

7 Claims, 6 Drawing Sheets

GAS DISCHARGE LAMP

TECHNICAL FIELD OF THE INVENTION

The present invention generally relates to gas discharge lamps, and more particularly to a gas discharge lamp having an UV unit for lowered starting voltage and enhanced starting efficiency, and for avoiding temperature-induced cracking to the lamp's glass body.

DESCRIPTION OF THE PRIOR ART

FIG. 1 shows a conventional gas discharge lamp commonly found in applications such as projectors, transportation vehicles, etc., where a high degree of brightness is required. As illustrated, the gas discharge lamp 1 is made of glass and has a discharge chamber 2 with two oppositely extended sealed neck members 3 and 4. Within the discharge chamber 2, there are electrodes 5 extended from the neck members 3 and 4, respectively, and gases capable of being ionized. Within the neck members 3 and 4, the electrodes 5 are connected via conduction wires 7 to molybdenum (Mo) tinsels 6, which in turn are connected to conduction wires 8 extending outside the neck members 3 and 4, respectively.

Delayed start is a commonly known disadvantage of the gas discharge lamp just described. This delayed start would breed the users' distrust in the quality of the product, in addition to the inconvenience of waiting. Moreover, the gas discharge lamp usually operates under a very high temperature and an air-cooling heat dissipation mechanism is provided for protection. However, it is frequently encountered that the glass body of the gas discharge lamp explodes from the stress arising out of temperature difference. To replace the gas discharge lamp is not only inconvenient but also costly.

SUMMARY OF THE INVENTION

A major objective of the present invention is therefore to provide a novel gas discharge lamp having an integrated UV unit so that, when the gas discharge lamp is turned on, UV (ultra-violet) light is produced to help reducing starting voltage and enhancing starting efficiency. Additionally, the configuration of the UV unit could also help preventing the cracking of the lamp body by temperature-induced stress.

To achieve the objective, the gas discharge lamp contains a lamp body and an UV unit. The lamp body contains a discharge chamber and sealed neck members oppositely extended from the discharge chamber. Within the discharge chamber, there are electrodes extended from the neck members, respectively, and gases capable of being ionized. Within the neck members, Mo tinsels are embedded and connected to the electrodes through first conduction wires, and to two conduction wires extended out of the neck members, respectively. The UV unit contains a separate airtight chamber wrapping around at least one of the neck members that covers at least a part of the Mo tinsel inside. The airtight chamber is filled with one or more gases capable of being ionized, and is wound by a conductor whose one end is connected to the conduction wire extended out of one of the neck members via a third conduction wire. When the gas discharge lamp is turned on, an electrical field is produced by the conductor and the gases in the airtight chamber are ionized to produce an UV light to penetrate the discharge chamber. The gas discharge lamp therefore could have a lower starting voltage and an improved starting efficiency. Additionally, as the airtight chamber provides a heat insulation effect for the glass body to the outside air flow, the temperature-induced stress is thereby reduced and the glass body's cracking or explosion is prevented. The gas discharge lamp therefore has an extended operational life span.

Preferably, the airtight chamber is preliminarily formed by glass and then fixedly joined to the gas discharge lamp by fritting. This separately formed airtight chamber could be independently designed to have an appropriate size and to have appropriate gases, and could be modularized for mass production. The present invention is therefore easy to implement and has practical value.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
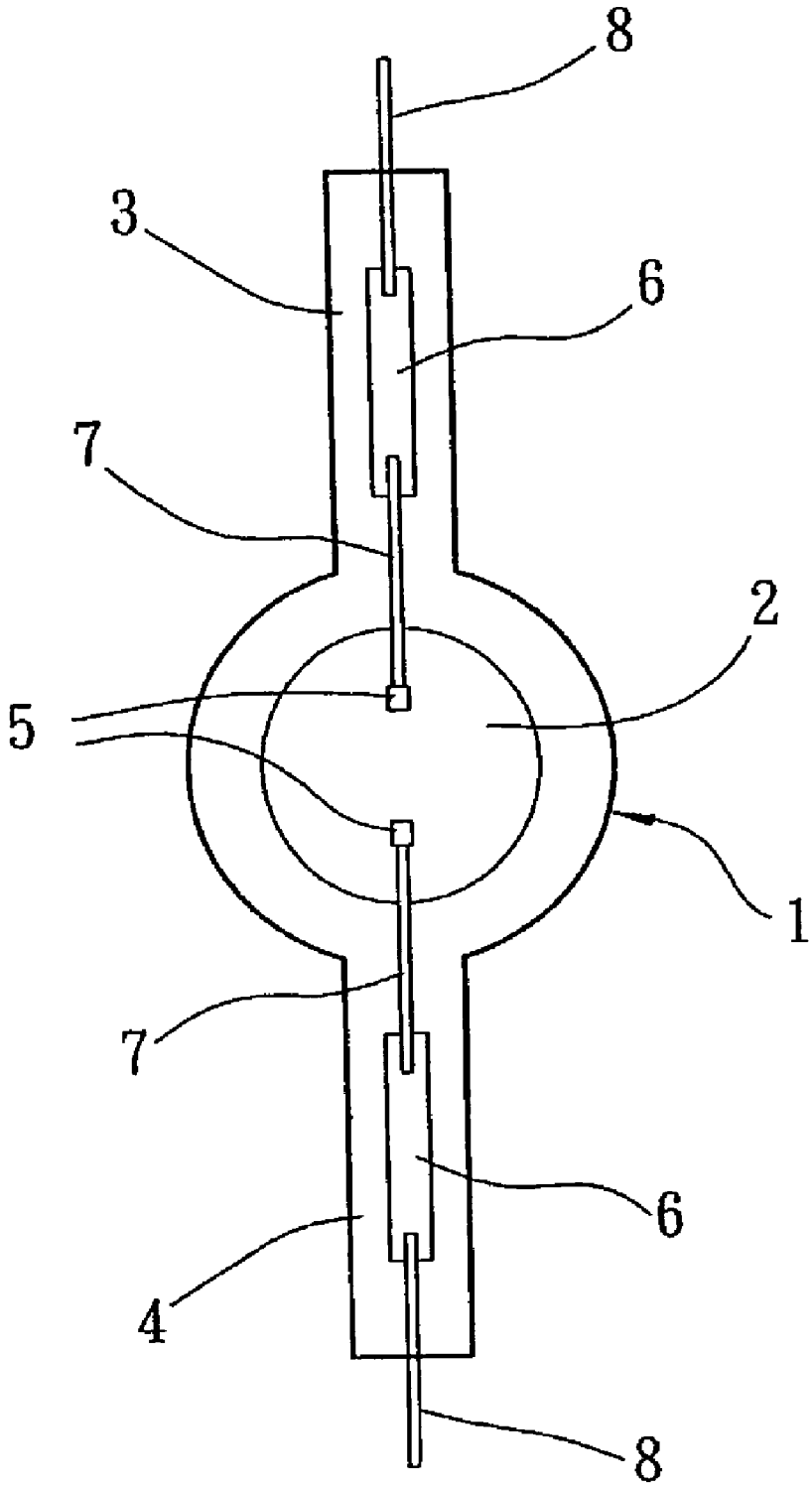
FIG. 1 PRIOR ART
FIG. 1 is a profile diagram showing a conventional gas discharge lamp.
Figure 2:
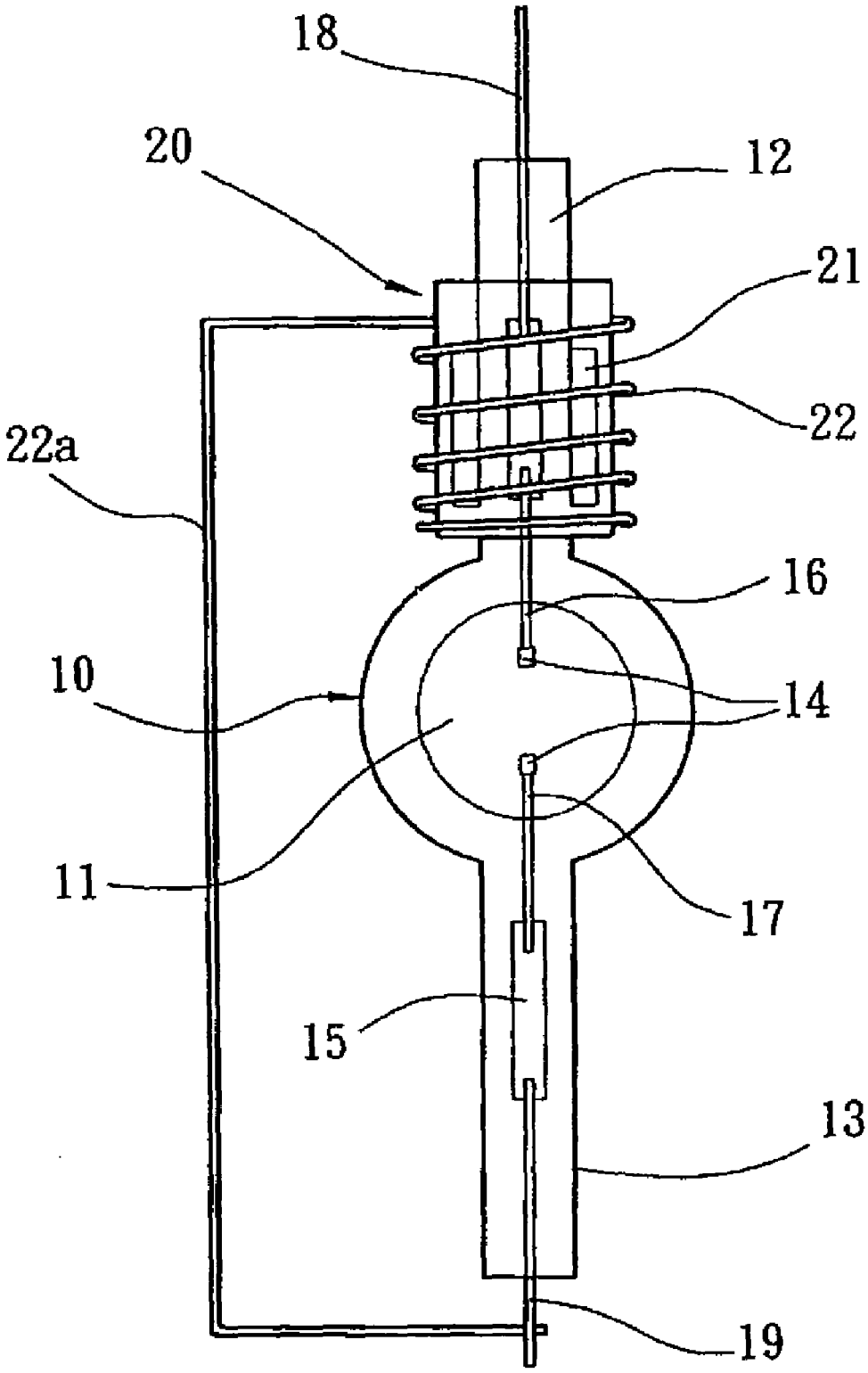
FIG. 2 is a profile diagram showing a gas discharge lamp according to a first embodiment of the present invention.
Figure 3:
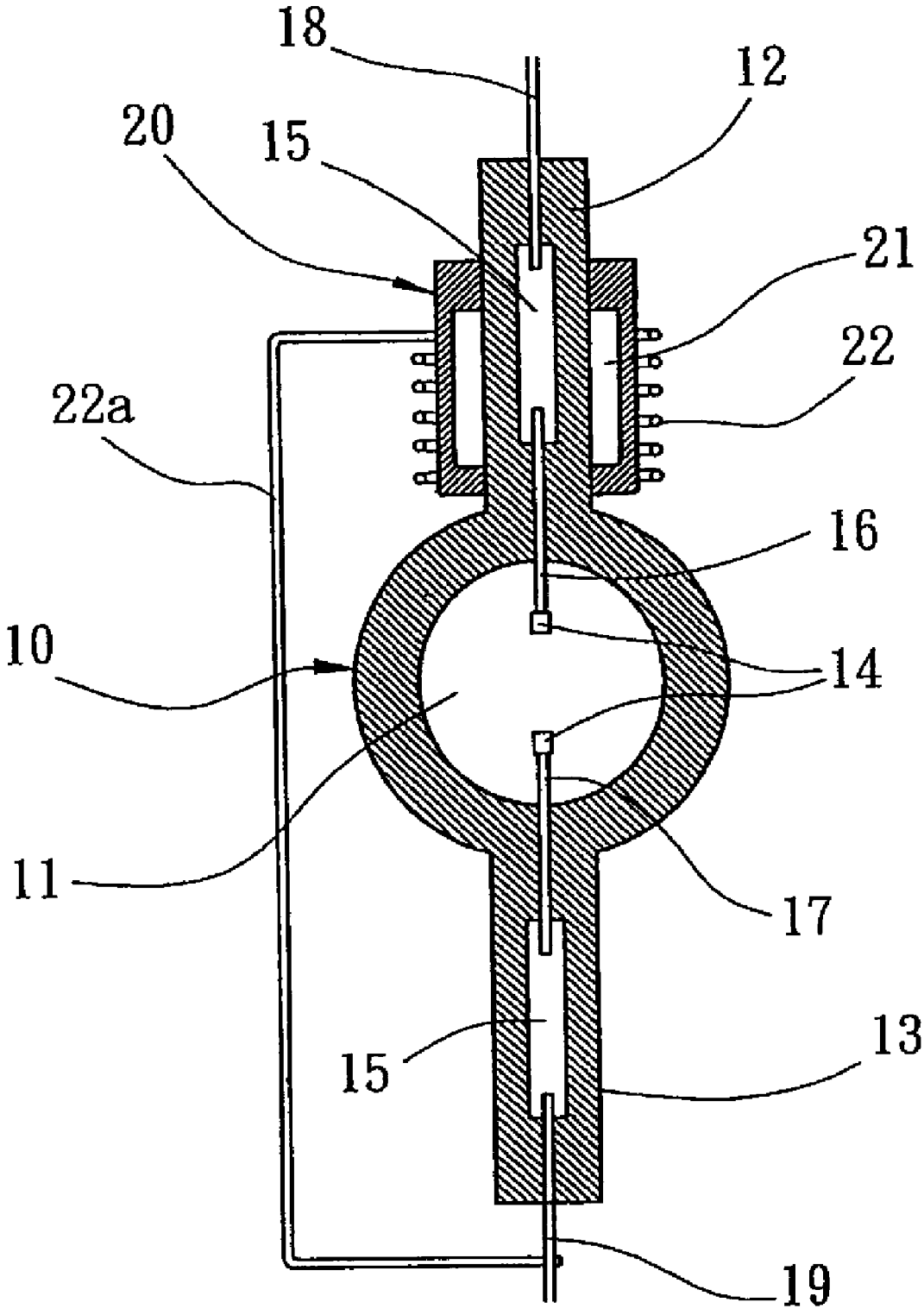
FIG. 3 is a sectional diagram showing the gas discharge lamp of FIG. 2.

As shown in FIGS. 2 and 3, a gas discharge lamp according to a first embodiment of the present invention contains a lamp body 10 and an UV unit 20. The lamp body 10 contains a discharge chamber 11 and sealed neck members 12 and 13 oppositely extended from the discharge chamber 10. Within the discharge chamber 11, there are electrodes 14 extended from the neck members 12 and 13, respectively, and gases capable of being ionized. Within the neck members 12 and 13, Mo tinsels 15 are embedded and connected to the electrodes 14 through first conduction wires 16 and 17, respectively. The Mo tinsels 16 are then connected to two conduction wires 18 and 19 and extended out of the neck members 12 and 13, respectively. The UV unit 20 contains a separate airtight chamber 21 wrapping around one of the neck members 12 and 13. In the present embodiment, it is positioned around the neck member 12. The airtight chamber 21 is long enough to cover a part of or the entire length of the Mo tinsel 15 inside the neck member 12. The airtight chamber 21 is filled with one or more gases capable of being ionized, and is wound by a conductor 22 whose one end is connected to the conduction wire 19 extended out of the other neck member 13 via another conduction wire 22*a*.

Preferably, the airtight chamber 21 of the UV unit 20 is preliminarily formed by glass and then fixedly joined to the lamp body 10 of the gas discharge lamp by fritting. This separately formed airtight chamber 21 could be independently designed to have an appropriate size and to have appropriate gases, and could be modularized for mass production. The gases selected for the airtight chamber are those even easier to be ionized to produce UV light such as a combination of argon (Ar) and mercury (Hg), or a combination of argon (Ar) and neon (Ne).

Figure 4:
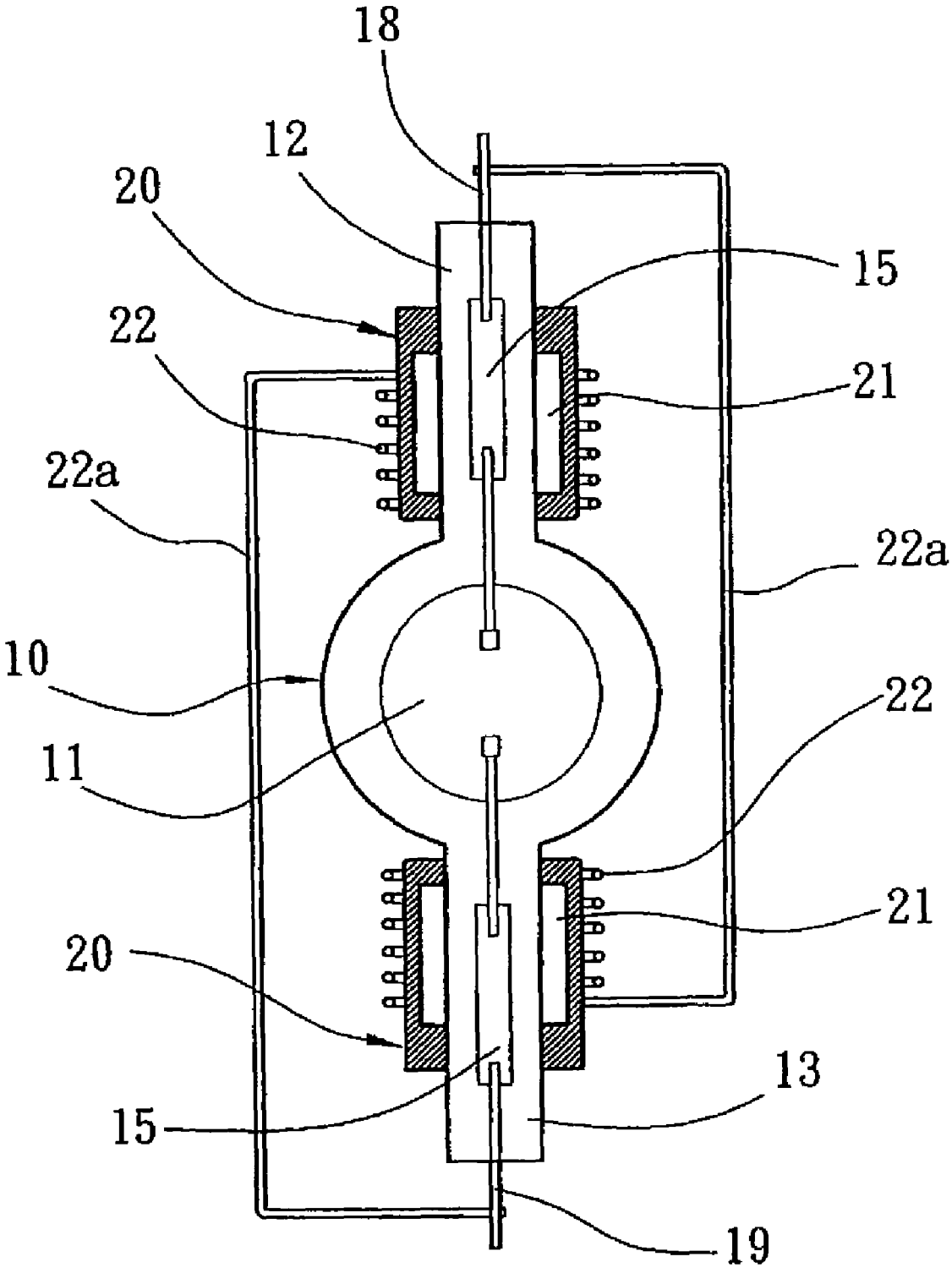
FIG. 4 is a sectional diagram showing a gas discharge lamp according to a second embodiment of the present invention.
Figure 5:
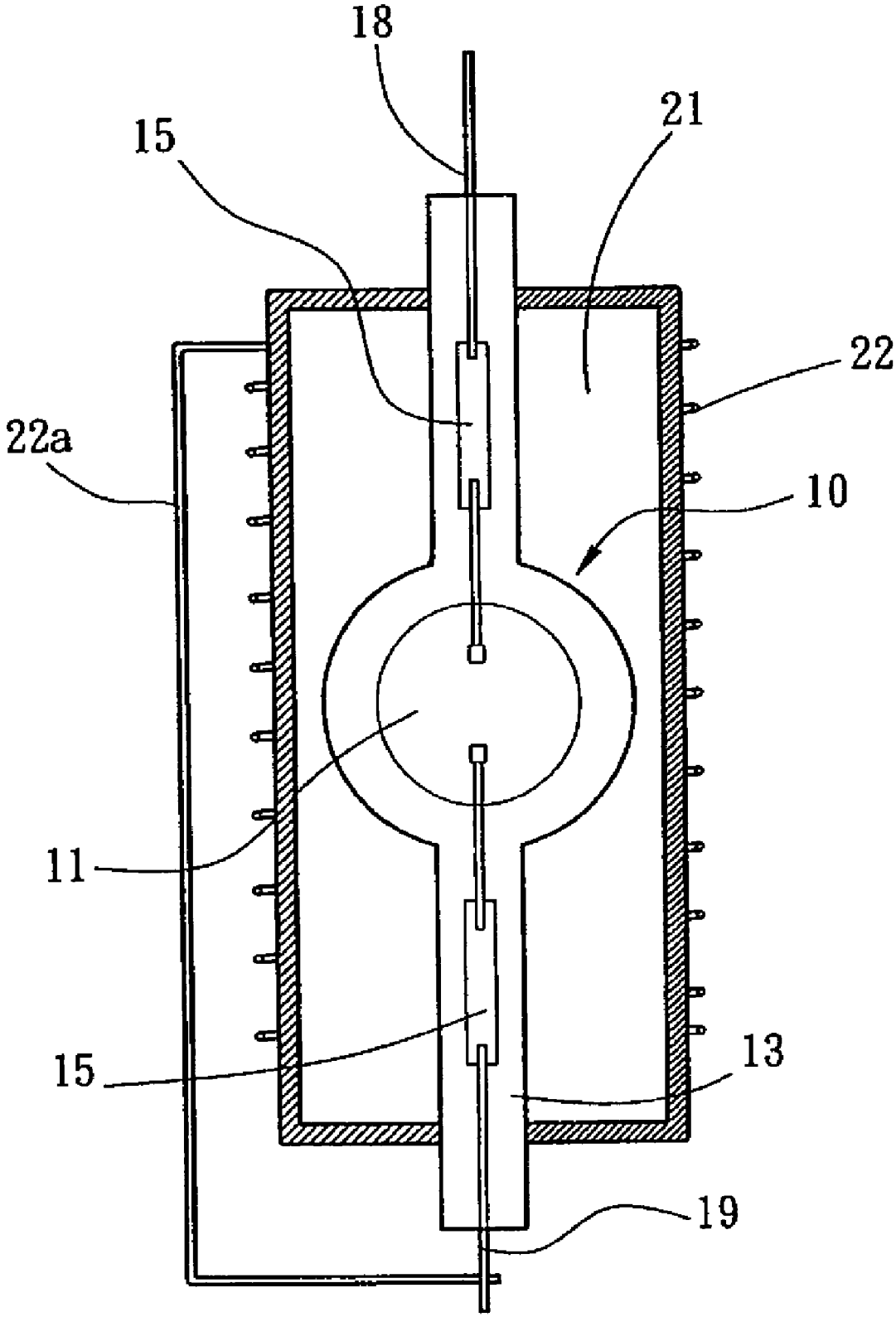
FIG. 5 is a sectional diagram showing a gas discharge lamp according to a third embodiment of the present invention.

FIG. 4 shows a second embodiment of the gas discharge lamp of the present invention. As illustrated, the UV unit 20 contains two airtight chambers 21 wrapping around the neck members 12 and 13, respectively. Each airtight chamber 21 is filled with one or more gases capable of being ionized, and is wound by a conductor 22 whose one end is connected to the conduction wire 18 or 19 extended out of the opposing neck member 12 or 13 via another conduction wire 22*a*. FIG. 5 shows a third embodiment of the gas discharge lamp of the present invention. As illustrated, the UV unit 20 contains a single airtight chamber 21 wrapping around the lamp body 10. The airtight chamber 21 covers the entire discharge chamber 11 and at least a part of the Mo tinsels 15 inside the neck members 12 and 13, respectively. The single airtight chamber 21 is filled with one or more gases capable of being ionized, and is wound by a conductor 22 whose one end is connected to the conduction wire 18 or 19 extended out of one of the neck members 12 and 13 via another conduction wire 22*a*.

Figure 6:
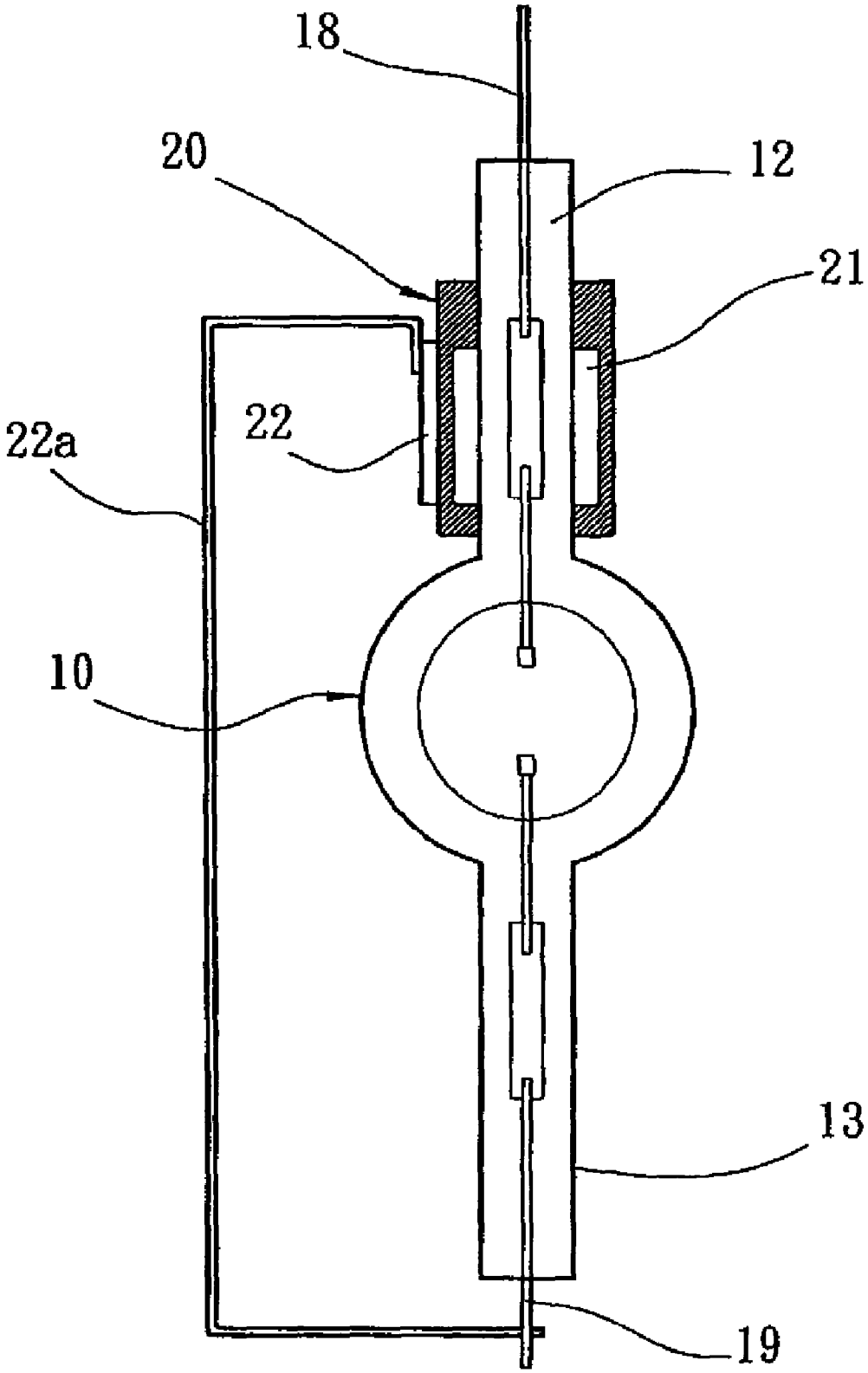
FIG. 6 is a sectional diagram showing a gas discharge lamp according to a fourth embodiment of the present invention.

In the foregoing embodiments, the conductor 22 is for producing an electrical field when the gas discharge lamp is turned on in the airtight chamber 21 wrapped by the conductor 22. The conductor 22 could be configured into a coil around the airtight chamber 21 as described so far. Alternatively, as shown in FIG. 6, the conductor 22 is configured into a plate positioned besides the airtight chamber 21. The plate conductor 22 is then connected to the conduction wire 19 extended out of the opposing neck member 13 via another conduction wire 22*a*. Yet another alternative configuration of the conductor 22 (not shown) is that it is coated as a film around the airtight chamber 21 and then connected to the conduction wire extended out of the opposing neck member.

As mentioned above, the airtight chamber 21 of the UV unit 20 is filled with a combination of gases containing one or more of the following gases: argon (Ar), mercury (Hg), krypton (Kr), Xenon (Xe), and neon (Ne). For example, for a combination of Ar and Hg, or a combination of Ar and Ne, it is capable of producing UV light at wavelength 100~380 nm. For reducing starting voltage and for enhancing starting efficiency, the two combinations are effective and easy-to-produce filling for the airtight chamber 21. However the combinations are exemplary only and are not intended to limit the present invention. Any other combination of one or more other gases capable of producing the effect could be used to fill the airtight chamber 21 as well. Similarly, any airtight chamber, regardless of its shape and position variations, should be considered covered by the preset invention as long as it is an airtight enclosure separate from the lamp body.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A gas discharge lamp, comprising:

a lamp body having a discharge chamber and two sealed neck members oppositely extended from said discharge chamber, said discharge chamber containing two electrodes and at least a gas capable of being ionized, each neck member having a molybdenum (Mo) tinsel inside, each Mo tinsel in a neck member having its two ends connected to an electrode via a first conduction wire and to a second conduction wire extending out of said neck member; and an UV unit having a conductor and at least an independent airtight chamber outside said lamp body covering at least a part of a Mo tinsel inside a neck member, said airtight chamber containing one or more of gases capable of being ionized, said conductor being positioned outside said airtight chamber and connected to a second conduction wire out of a neck member via a third conduction wire.

2. The gas discharge lamp according to claim 1, wherein said airtight chamber is preliminarily formed of glass and is fixedly joined to an external surface of said lamp body by fritting.

3. The gas discharge lamp according to claim 1, wherein said airtight chamber wraps around a neck member; and said conductor is connected to said second conduction wire out of the opposing neck member.

4. The gas discharge lamp according to claim 1, wherein said UV unit further comprises a second airtight chamber; each of said airtight chamber and said second airtight chamber wraps around a neck member; and said conductor is connected to said second conduction wire out of the opposing neck member.

5. The gas discharge lamp according to claim 1, wherein said airtight chamber covers said discharge chamber and at least a part of said Mo tinsels embedded in said neck members.

6. The gas discharge lamp according to claim 1, wherein said conductor is configured into one of a coil around, a plate besides, and a film of coating around said airtight chamber.

7. The gas discharge lamp according to claim 1, wherein said gas filled in said airtight chamber is a combination of at least one of the following gases: argon (Ar), mercury (Hg), krypton (Kr), Xenon (Xe), and neon (Ne).

* * * * *